United States Patent [19]

Maeda

[11] 4,400,931

[45] Aug. 30, 1983

[54] BELT-TYPE FALSE TWISTING UNIT

[75] Inventor: Yoshiyasu Maeda, Yamato kouriyama, Japan

[73] Assignee: Murata Kikai Kabushiki Kaisha, Kyoto, Japan

[21] Appl. No.: 317,922

[22] Filed: Nov. 3, 1981

[30] Foreign Application Priority Data

Nov. 7, 1980 [JP] Japan ..... 55-157242
Oct. 23, 1981 [JP] Japan ..... 56-169831

[51] Int. Cl.[3] ..... D02G 1/04; D02G 1/08
[52] U.S. Cl. ..... 57/336
[58] Field of Search ..... 57/334, 336, 348

[56] References Cited

U.S. PATENT DOCUMENTS 2,262,589 11/1941 Peck ..... 57/336 X
2,991,614 7/1961 Ubbelohde ..... 57/336
3,045,416 7/1962 Ubbelohde ..... 57/334

*Primary Examiner*—Donald Watkins
*Attorney, Agent, or Firm*—Spensley, Horn, Jubas & Lubitz

[57] ABSTRACT

A belt-type false twisting unit of the false twisting apparatus. First and second endless belts are running in directions opposite to each other to nip a yarn therebetween in the portion of intersection so that the yarn is false-twisted. A pressing roller is arranged to press a back surface of one of the belts in the portion of intersection.

7 Claims, 9 Drawing Figures

BELT-TYPE FALSE TWISTING UNIT

BACKGROUND OF THE INVENTION

A false twisting apparatus in which two belts are travelled in directions opposite to each other and a yarn is nipped between the two belts to false-twist the yarn has been known. More specifically, in this known false twisting apparatus, two flexible belts are travelled in directions opposite to each other so that they intersect each other at a predetermined angle of intersection, and by nipping a yarn between the two belts, a component of the force for travelling the belts is divided into a force for turning the yarn and a force for feeding out the yarn, whereby the yarn is false-twisted.

In such belt-type false twisting apparatus, at the point of intersection, the two belts are compressed to each other through face-to-face contact and a yarn is nipped at such point of intersection between the two belts. In this case, false twisting of the yarn is performed relatively stably. However, since the belts are travelled in opposite directions with a certain angle of intersection, friction is caused between the contact surfaces of the belts, and the lives of the belts are shortened unless a lubricant such as water or an oiling agent is always supplied to the contact surfaces.

Furthermore, since the yarn nipped at the point of intersection of the belts is held between the contact surfaces of the belts along a length longer than the width of the belts, the nip point, that is, the twisting point, is perpetually changed, and the distances of the twisting zone and untwisting zone are not kept constant. Accordingly, if the twisting point shifts to the twisting side, an excessively untwisted portion is formed on the yarn. On the contrary, if the twisting point shifts to the untwisting side, a non-untwisted portion is formed on the yarn. Therefore, a uniformly false-twisted yarn cannot be obtained and the quality of the product yarn is degraded.

Furthermore, there is known a false twisting unit in which in order to facilitate the operation of passing a yarn through a portion where belts intersect each other, a bracket supporting pulleys on which the belts are hung is disposed so that the bracket can turn with one axis being as the fulcrum. In this false twisting unit, means for positioning the bracket should additionally be disposed, and the bracket is shaken by a yarn running at a high speed and the contact pressure between the belts is readily changed at the twisting point, with the result that uneven twisting is often caused.

SUMMARY OF THE INVENTION

The present invention relates to a false twisting apparatus. More particularly, the present invention relates to a belt-type false twisting unit. An object of the present invention is to eliminate the foregoing defects involved in the conventional techniques.

A further object of the present invention is to provide a belt-type false twisting unit in which a pressing roller is arranged to press a back surface of one belt in the portion of intersection of first and second belts running in directions opposite to each other.

According to the present invention, one belt is bent in conformity with the surface of the pressing roller in the portion of intersection of the belts and two belts are caused to fall in point-to-point or line-to-line contact with each other by this pressing force, and a yarn is nipped in this contact portion between the two belts, whereby the point of contact between the yarn and the belts, that is, the twisting point, is kept at a certain position.

By virtue of this structural feature, the area of contact between the two belts is diminished and friction wearing of the belts or generation of heat is controlled, resulting in prolongation of the lives of the belts. Furthermore, the yarn nip point is set at a certain position and excessive untwisting or non-twisting is prevented, and therefore, a false-twisted yarn having high quality can be obtained.

DETAILED DESCRIPTION OF THE INVENTION

The present invention will now be described in detail with reference to embodiments illustrated in the accompanying drawings.

Figure 1:
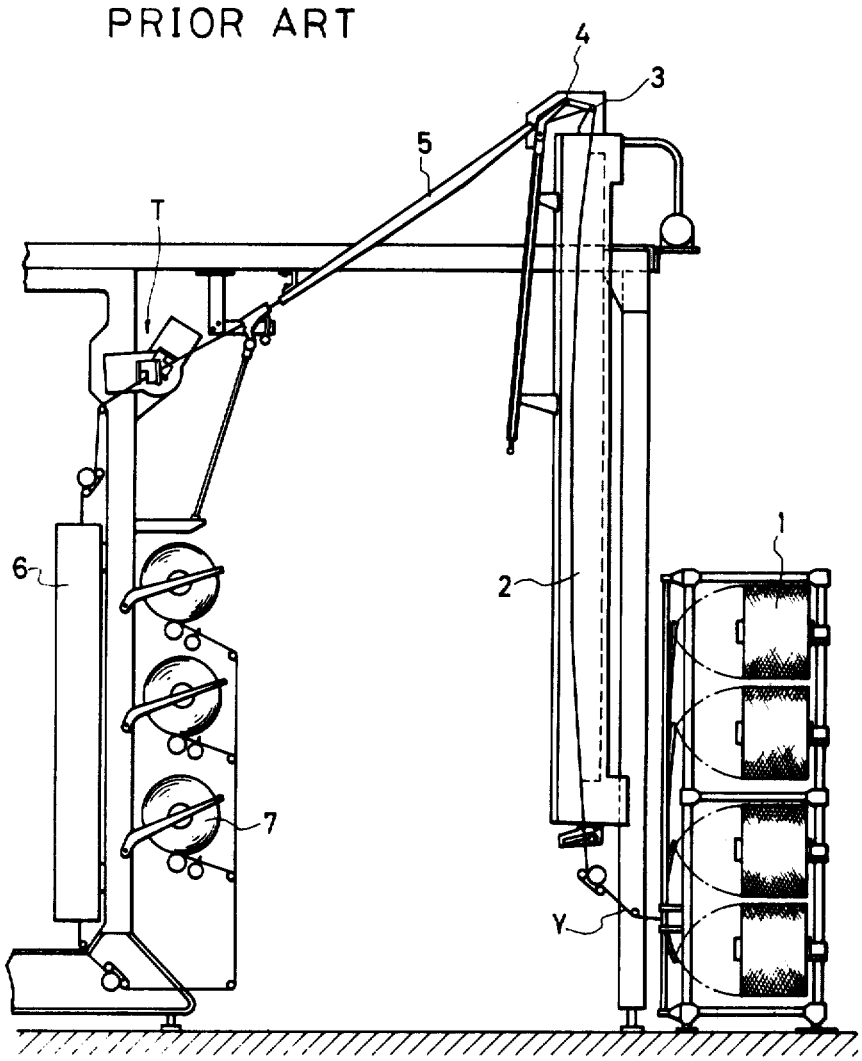
FIG. 1 PRIOR ART
FIG. 1 is a schematic side view showing an example of the conventional false twisting apparatus.

FIG. 1 is a diagram illustrating schematically the structure of a false twisting apparatus having a belt-type false twisting unit.

Referring to FIG. 1, a yarn Y taken out from a yarn feed bobbin 1 rises through a twist-fixing heater 2 and is then introduced into a balloon guide 5 through direction changing rollers 3 and 4. The yarn Y is cooled in the zone of the balloon guide 5 and in some case, the yarn Y is then passed through a cooling device. The cooled yarn is then introduced into a belt-type false twisting unit T. The yarn coming out from the false twisting unit T is introduced into a torque-eliminating heater 6 and is then guided to a winding zone and wound on a winding bobbin 7.

Figure 2:
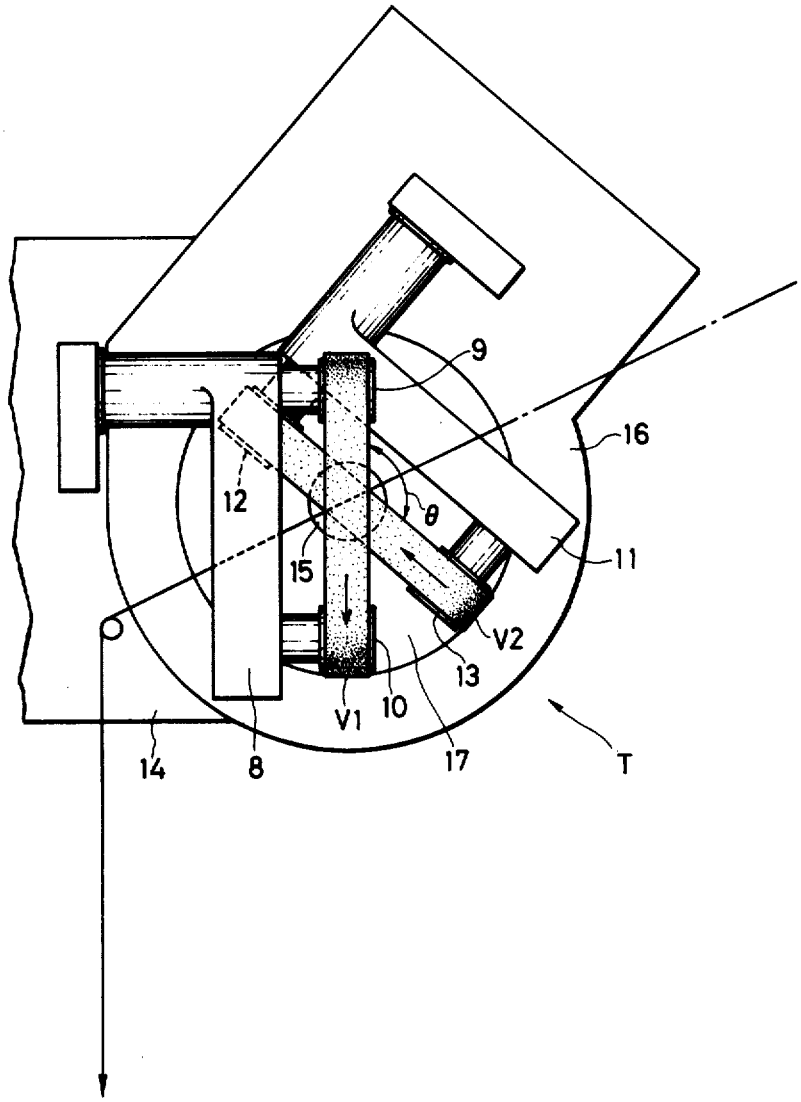
FIG. 2 is a diagram illustrating schematically a belt-type false twisting unit.

Referring to FIG. 2 illustrating schematically the structure of the false twisting unit T, a first endless belt V1 hung on pulleys 9 and 10 of a bracket 8 and a second endless belt V2 hung on pulleys 12 and 13 of a bracket 11 are caused to intersect each other at a predetermined angle of intersection, and they are travelled in directions opposite to each other as indicated by arrows. In this state, a yarn is passed through between the belts V1 and V2 under a certain contact pressure to impact the twisting and feeding forces, which are components of the belt-travelling force, to the yarn.

The bracket 8 is secured to a base plate 14 which is rotatable with a stationary shaft 15 being as the center, and the bracket 11 is secured to a base plate 16 which is rotatably supported on a projecting disc 17 formed on the other base plate 14. Accordingly, the brackets 8 and 11 can rotate only on one plane parallel to the paper surface of FIG. 2 and the intersection angle $\theta$ of the belts V1 and V2 can optionally be adjusted.

Figure 3:
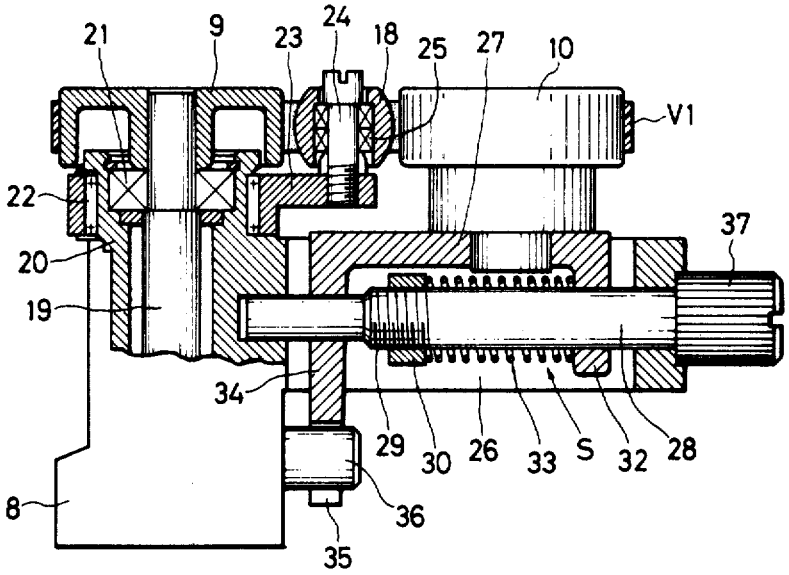
FIG. 3 is a sectional side view illustrating the belt V1 in one embodiment of the false twisting unit according to the present invention.
Figure 4:
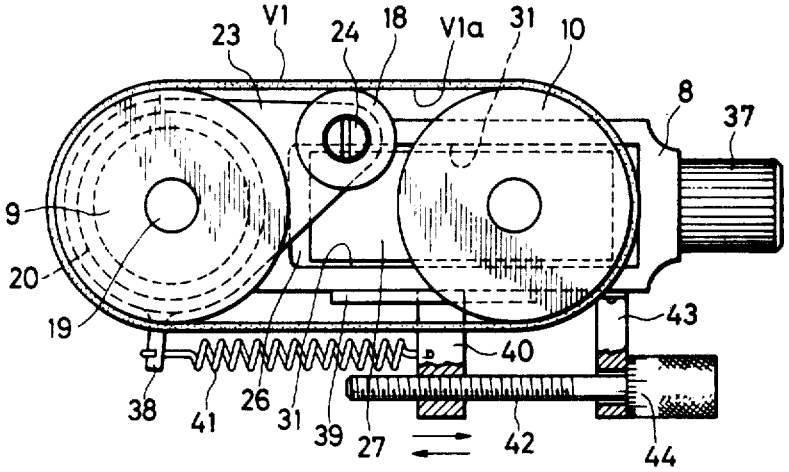
FIG. 4 is a plan view showing the false twisting unit illustrated in FIG. 3.

Referring to FIGS. 3 and 4 showing a spherical roller 18 mounted on one bracket 8, the pulley 9 is secured to a driving shaft 19 rotatably supported on the bracket 8 and the belt V1 is hung between this pulley 9 and the other pulley 10. The driving shaft 19 is supported in a hollow stationary cylinder 20 through a bearing 21, and a lever 23 is turnably supported on the cylinder 20 through a needle bearing 22. A shaft 24 is secured to the top end portion of the lever 23 in parallel to the driving shaft 19, and the roller 18 is rotatably supported on the shaft 24 through a bearing 25. Accordingly, the roller 18 can be pressed to or separated from the back surface V1a of the belt V1 by turning the lever 23. The surface of the roller 18 is spherical.

A tension-adjusting mechanism S for the belt V1 hung on the pulleys 9 and 10 is mounted on the bracket 8. Such tension-adjusting mechanism is similarly mounted on the bracket 11. This tension-adjusting mechanism will now be described only with respect to the bracket 8.

A ⊐-shaped support supporting the pulley 10 thereon is arranged in a window 26 formed on the bracket 8, and a rod 28 piercing through the support 27 is rotatably supported on the bracket 8. A portion 29 of the rod 28 is threaded and an angular plate 30 is screwed to the threaded portion 29 so that when the rod 28 is turned, the angular plate 30 is caused to fall in abutting contact with side walls 31 of the bracket 8 and is prevented from rotation but allowed to move along the threaded portion 29.

A spring 33 is wound and supported on the rod 28 between the angular plate 30 and a side plate 32 of the pulley support 27 to urge the pulley support 27 to the right in FIG. 3.

The other side plate 34 of the pulley support 27 is located astride a pin 36 secured in the bracket 8 and has a U-groove 35 formed on the top end thereof. The pin 36 acts as a moving guide while inbiting turning of the pulley support 27 around the rod 28.

Accordingly, if a knob 37 on the end portion of the rod 28 is turned, the threaded portion 29 of the rod 28 is turned to move the angular plate 30 to the right or left and change the force of the spring 33, whereby the tension on the V1 hung between the pulleys 9 and 10 can be adjusted.

FIG. 4 illustrates one embodiment of the mechanism for operating the lever 23 supporting the roller 18 thereon. Referring to FIG. 4, a projection 38 is formed on the end portion of the lever 23 and a spring 41 is connected between this projection 38 and a slider 40 movable along a grooved guide 39 secured to the side face of the bracket 8.

In this structure, the lever 23 is urged around the cylinder 20 in the counterclockwise direction by the spring 41. A threaded rod 42 is engaged with a female screw formed on the slider 40, and the threaded rod 42 is supported while piercing through a block 43 secured to the bracket 8. Accordingly, if the threaded rod 42 is turned, the slider 40 is moved to the right or left. When the slider 40 is moved to the right, the spring 41 is stretched to increase the urging force on the lever 23, whereby the contact pressure of the roller 18 on the back surface of the belt V1 is increased.

If a dial 44 is arranged on the periphery of the rod 42, the pressing force 18 of the roller 18 can easily be set to a desirable level by utilizing the dial 44.

Figure 7:
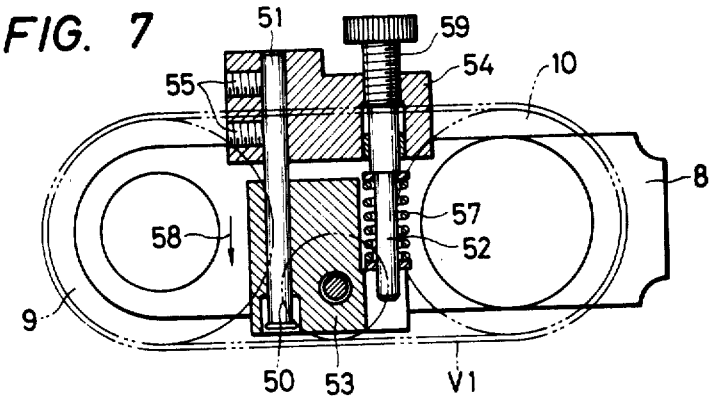
FIG. 7 is a sectional plan view showing the belt V1 in another embodiment of the false twisting unit according to the present invention.
Figure 8:
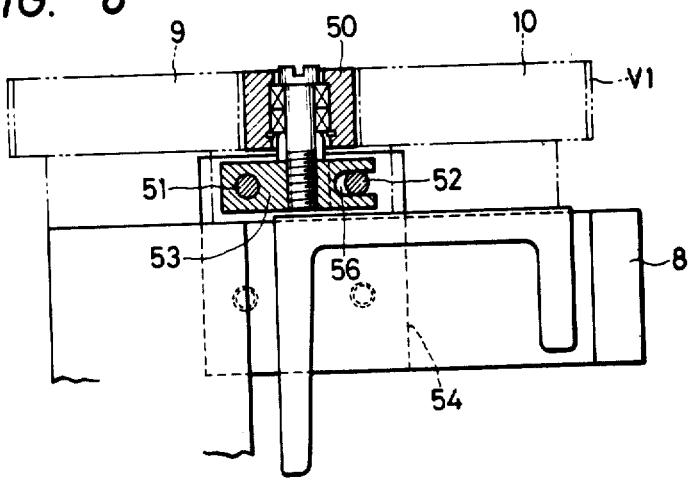
FIG. 8 is a sectional front view illustrating the false twisting unit shown in FIG. 7.

FIGS. 7 and 8 illustrate another embodiment of the false twisting unit according to the present invention. In this embodiment, a pressing roller 50 is arranged to perform a linear movement. Instead of the turning lever 23 in the foregoing embodiment, a slide block 53 is disposed slidably along linear guide bars 51 and 52, and the pressing roller 50 is rotatably supported on the slide block 53.

The guide bar 51 is secured through a pin 55 to a block 54 secured to the bracket 8 supporting the pulleys 9 and 10 thereon, and the other guide bar 52 is screwed in the block 54. The slide block 53 is inserted into the guide bar 51 and a U-groove 56 of the slide block 53 is supported on the guide bar 52. A coil spring 57 is wound on the guide bar 52 to urge the slide block 53 in the direction indicated by an arrow 58, whereby the roller 50 rotatably supported on the slide block 53 is pressed to the back surface of the belt V1. Since a threaded portion 59 is formed on the guide bar 52, by rotation of the guide bar 52, the force of urging the roller 50 by the spring 57 can be adjusted.

If the guide bars 51 and 52 are arranged to extend at a right angle to the line connecting the centers of the pulleys 9 and 10 to each other, the roller 50 is pressed to the back surface of the belt V1 at a right angle thereto, and good results can be obtained.

Figure 9:
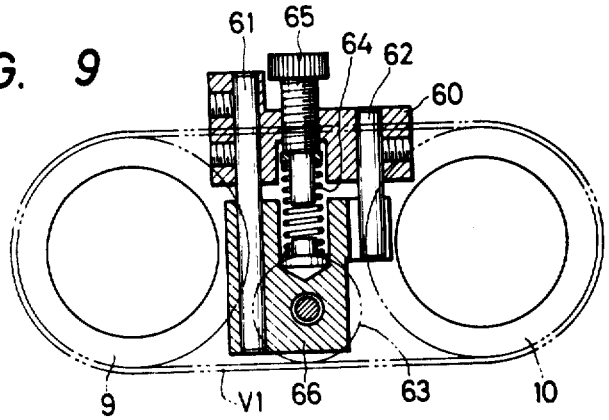
FIG. 9 is a sectional plan view illustrating still another embodiment of the false twisting unit according to the present invention.

Referring to FIG. 9 illustrating still another embodiment, two guide bars 61 and 62 are secured to a block 60, and a coil spring 64 for adjusting the pressing force of a roller 63 supported on a block 66 is wound on a threaded rod 65 arranged on the straight line passing through the central axis of the roller 63 in parallel to the guide bars 61 and 62. One end of the spring 64 is inserted in a hole of the slide block 66.

Figure 5:
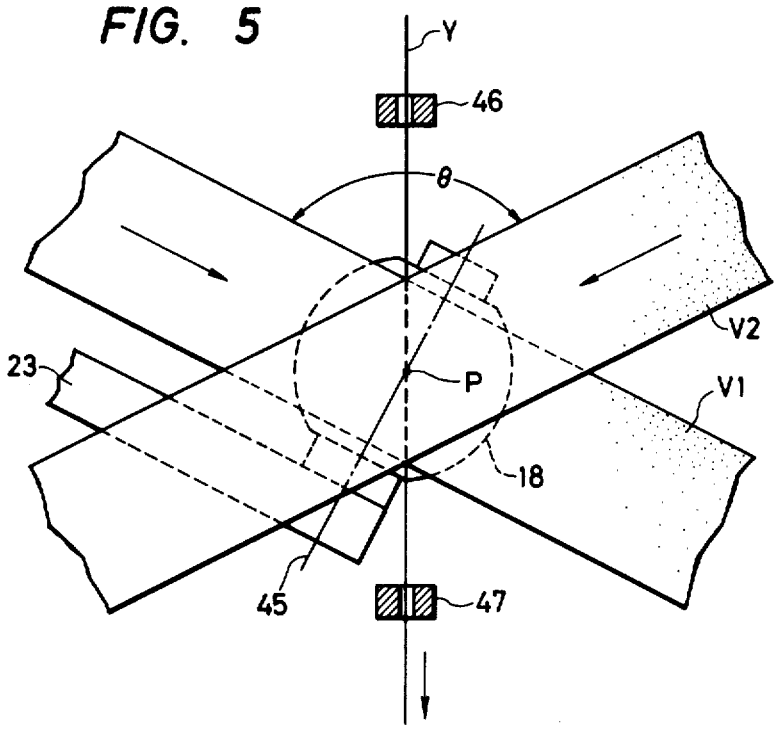
FIG. 5 is an enlarged side view showing the portion of intersection of the belts V1 and V2 in the false twisting unit shown in FIG. 3.
Figure 6:
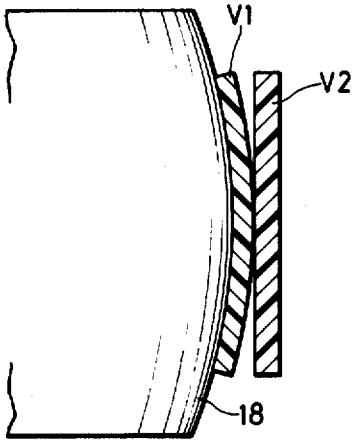
FIG. 6 is a sectional front view showing an example of the contact state in the portion of the intersection shown in FIG. 5.

In the false twisting unit of the present invention having the above-mentioned structure, when the false twisting operation is carried out while nipping a yarn between the belts, if the roller 18 is pressed to the back surface of the first belt V1 intersecting the second belt V2 at an intersection angle $\theta$ as shown in FIG. 5, the first belt V1 is bent in conformity with the shape of the surface of the roller 18 as shown in FIG. 6 and the first belt V1 is brought into pressing contact with the second belt V2 in the intersecting portion. It is preferred that the roller 18 be mounted on the lever 23 so that the central axis 45 passing through the rotation center of the roller 18 passes through the central point of the intersecting portion of the belts, that is, the nip point P. In this structure, the contact between the first and second belts V1 and V2 should ideally be a point-to-point contact. However, actually, since also the second belt V2 is slightly bent, the contact becomes a line-to-line or face-to-face contact. According to the embodiments shown in FIGS. 7, 8 and 9, the first belt V1 is brought into line-to-line pressing contact with the second belt V2 in the intersecting portion. Such point-to-point or line-to-line contact has a much smaller contact area than in the case where the belts are contacted with each other throughout the intersecting portion.

Accordingly, the false twisting point (nip point P) is always set at the predetermined central position and the yarn is passed through the nip point P between the belts while being guided by the guides 46 and 47 arranged before and after the belts.

Therefore, the length of each of the twisting zone and untwisting zone with the nip point being as the boundary is always kept constant. When it is desired to change the intersection angle $\theta$ between the belts V1 and V2, if the belts V1 and V2 are moved by an equal angle, the nip point is not shifted in either the front-rear direction or the left-right direction but is kept at the same position.

The attachment positions of the brackets 8 and 11 are determined so that when the yarn does not pass through between the belts as in case of yarn breakage, the pressing pressure of the roller 18 is zero, that is, a certain gap is formed between the first and second belts in the intersecting portion by rotating the threaded rod 42, or 59, or 65, in the reverse direction.

The shape of the pressing roller 18 is not limited to the above-mentioned shape. In addition to such spherical and columnar rollers, there may be used a roller in which the cross-section passing through the rotation axis of the roller and being parallel to said axis is ellipsoidal. In the foregoing embodiments, the roller presses only one of the two belts. It is possible to provide a point-to-point contact between the two belts also in the case where both the belts are pressed by the roller. In this case, however, it is necessary to precisely set the attachment position of the pressing roller.

What is claimed is:

1. A belt-type false twisting unit comprising first and second belts running in directions opposite to each other and intersecting each other and a rotatable pressing roller falling in contact with the inner side of one of said first and second belts at the intersecting point, wherein by the pressing force of said pressing roller, said one belt is caused to fall in contact with the other belt in the state where said one belt is bent along the surface of the pressing roller and a yarn is nipped at the point of the contact between the two belts.

2. A belt-type false twisting unit as claimed in claim 1, wherein said rotatable pressing roller has a spherical surface.

3. A belt-type false twisting unit as claimed in claim 2, wherein the spherical pressing roller is rotatably supported on a shaft which is secured to the top end portion of a lever turnably supported on a bracket, a projection is formed on the other end portion of the lever and a spring is connected between the projection and a slider movable along the bracket so that the spring effects to turn the lever to increase or descrease the contact pressure of the pressing roller on the surface of the belt when the slider is moved.

4. A belt-type false twisting unit as claimed in claim 3, wherein a tension-adjusting mechanism for the belts is mounted on the bracket.

5. A belt-type false twisting unit as claimed in claim 1, wherein said rotatable pressing roller is a cylindrical roller.

6. A belt-type false twisting unit as claimed in claim 5, wherein the cylindrical pressing roller is rotatably mounted on a slide block which is disposed slidably along two guide bars extending at a right angle to the line connecting the centers of pulleys supporting the belt, said slide block being urged to press the roller against the belt by a coil spring wound on one end of the guide bar which is threaded at the other end to adjust the pressing force of the roller to the belt.

7. A belt-type false twisting unit as claimed in claim 5, wherein the pressing roller is rotatably mounted on a slide block which is disposed slidably along linear guide bars extending at a right angle to the line connecting the centers of pulleys supporting the belt, a threaded rod is arranged on the straight line passing through the central axis of the roller parallel to the guide bar and one end of the threaded rod wound by a coil spring is inserted in a hole of the slide block to press the roller to the belt and to adjust the pressing force.

* * * * *